US006784424B1

(12) United States Patent
Willoughby et al.

(10) Patent No.: US 6,784,424 B1
(45) Date of Patent: Aug. 31, 2004

(54) APPARATUS AND METHOD FOR FOCUSING AND SELECTING IONS AND CHARGED PARTICLES AT OR NEAR ATMOSPHERIC PRESSURE

(76) Inventors: Ross C Willoughby, 655 William Pitt Way, Pittsburgh, PA (US) 15238; Edward W Sheehan, 655 William Pitt Way, Pittsburgh, PA (US) 15238

( * ) Notice: Subject to any disclaimer, the term of this patent is extended or adjusted under 35 U.S.C. 154(b) by 49 days.

(21) Appl. No.: 10/155,151

(22) Filed: May 25, 2002

Related U.S. Application Data

(60) Provisional application No. 60/293,648, filed on May 26, 2001.

(51) Int. Cl.[7] ..... H01J 49/26
(52) U.S. Cl. ..... 250/292; 250/293; 250/299
(58) Field of Search ..... 250/292, 293, 250/299, 300

(56) References Cited

U.S. PATENT DOCUMENTS

| | | | | |
|---|---|---|---|---|
| 4,540,884 A | | 9/1985 | Stafford et al. | 250/282 |
| 5,521,380 A | * | 5/1996 | Wells et al. | 250/282 |
| 5,521,382 A | * | 5/1996 | Tanaka et al. | 250/292 |
| 6,107,628 A | | 8/2000 | Smith et al. | 250/292 |
| 6,124,592 A | * | 9/2000 | Spangler | 250/287 |
| 6,534,764 B1 | * | 3/2003 | Verentchikov et al. | 250/287 |
| 6,621,077 B1 | * | 9/2003 | Guevremont et al. | 250/292 |

FOREIGN PATENT DOCUMENTS

| | | |
|---|---|---|
| WO | 00/08456 | 2/2000 |
| WO | 00/08457 | 2/2000 |

OTHER PUBLICATIONS

Miller P.E., et al., "The quadrupole mass filter: Basic operating concepts," J. Chem. Ed. 63, pp. 617–622 (1986).

Hill, H.H., et al., "Ion mobility spectrometry," Anal. Chem. 62, pp. 1201A–1209A (1990).

Johnson, J.V., et al., "The stretched quadrupole ion trap: Implications . . . ," Rapid Commun. Mass Spectrom. 6, pp. 760–764 (1992).

Buryakov, I.A., et al., "A new method of separation of multi–atomic ions . . . ," Int. J. Mass Spectom. Ion Processes. 128, pp. 143–148 (1993).

Wittmer, D., et al., "Electrospray ionization ion mobility spectrometry," Anal. Chem. 66, pp. 2348–2355 (1994).

Thomson, B.A., et al., "Improved collisionally activated dissociation . . . ," J. Am. Soc. Mass Spectrom. 6, pp. 1696–1704 (1995).

(List continued on next page.)

*Primary Examiner*—Nikita Wells
*Assistant Examiner*—Anthony Quash

(57) ABSTRACT

The present invention relates to an apparatus and method for focusing, separating, and detecting gas-phase ions using the principles of quadrupole fields, substantially at or near atmospheric pressure. Ions are entrained in a concentric flow of gas and travel through a high-transmission element into a RF/DC quadrupole, through a second high-transmission element, and then impact on an ion detector, such as a faraday plate; or through an aperture with subsequent identification by a mass spectrometer. Ions with stable trajectories pass through the RF/DC quadrupole while ions with unstable trajectories drift off-axis collide with the rods and are lost. Embodiments of this invention are devices and methods for focusing, separating and detecting gas-phase ions without the need for a vacuum chamber when coupled to atmospheric ionization sources.

27 Claims, 10 Drawing Sheets

OTHER PUBLICATIONS

Thomson, B., et al., "RF–only quadrupple with axial fields," Proceedings of the 44th Meeting of the May 12–17, 1996, Portland, Oregon.

Steel, C., et al., "Understanding the quadrupole mass filter through computer simulation," J. Chem. Ed. 75, pp. 1049–1054 (1998).

TiTov, V.V., "Detailed study of the quadrupole mass anlayzer operating within . . . ," J. A. Soc. Mass Spectrom 9, pp. 50–69 (1998).

Kim, T. et al., "Design and implementation of a new electrodynamic ion funnel," Anal. Chem. 72, pp. 2247–2255 (2000).

* cited by examiner a. Conventional Quadrupole Assembly b. Atmospheric Pressure Quadrupole Assembly c. Applied Potentials Positive Rods: $V_t = V_{dc} + V_{rf} \cos \varpi t + V_{ion\ energy}$ Negative Rods: $V_t = -V_{dc} - V_{rf} \cos \varpi t + V_{ion\ energy}$

APPARATUS AND METHOD FOR FOCUSING AND SELECTING IONS AND CHARGED PARTICLES AT OR NEAR ATMOSPHERIC PRESSURE

CROSS-REFERENCE TO RELATED APPLICATION

This application is entitled to the benefit of provisional Patent Application Ser. No. 60/293,648, filed May 26, 2001. In addition this invention uses the high transmission element of our co-pending application, Ser. No. 09/877,167, Filed Jun. 8, 2001.

GOVERNMENT SUPPORT

The invention described herein was made with United States Government support under Grant Number: 1 R43 RR15984-01 from the Department of Health and Human Services. The U.S. Government may have certain rights to this invention.

BACKGROUND—FIELD OF INVENTION

This invention relates to an atmospheric RF/DC device, specifically to such RF/DC devices which are used for analyzing gas-phase ions at atmospheric pressure.

BACKGROUND—DESCRIPTION OF PRIOR ART

Quadrupole Mass Spectrometry (QMS)

The analytical utility of a RF/DC (radio frequency/direct current) mass filter or analyzers, such as a quadrupole mass filter, as a device for continuous selection and separation of ions under conventional vacuum conditions is well established. It also has a highly developed theoretical basis (1, 2, 3, 4, 5, 6). The desirable performance attribute of the quadrupole mass filter is the fact that motion in the x, y, and z directions are decoupled, (i e. motion in each direction is independent of motion of the other directions in the Cartesian coordinate system) (7). In general, a time varying potential is applied to opposite sets of parallel rods as illustrated in FIG. 1.

The "hyperbolic" geometry in the x-y plane coupled with the appropriate time-varying applied potential (an RF field) creates a pseudo-potential well that will trap ions within a "stable" mass range along the centerline of the x-y plane (the z-axis), while ejecting ions of "unstable" mass in the x and y directions. In a quadrupole operated a low pressures (under vacuum, $<10^{-3}$ torr), motion along the z-axis is generally determined by the initial energy of the ions as they enter the quadrupole field, and can be generally considered equivalent to motion in a field free environment. One notable exception to this field-free model would be the effects the fringing fields at the entrance and exit of the quadruple. At the entrance and exit from quadrupoles the x, y and z motions are coupled. This results in the transfer of small amounts of translational energy between the different dimensions. The effects of which can generally be reduced dramatically through electrode design (e.g. the use of RF-only pre- and post-filters).

Ion motion within a quadrupole is well characterized, and is described by the various solutions of the Mathieu equation (8). Simply stated, for a given ion with a particular mass-to-charge ratio (m/z), there exist sets of RF (alternating at the radio frequency) and DC (direct current) voltages, which when applied to a quadrupole yield stable trajectories. These sets of RF and DC voltages can be plotted to represent regions of stability both in the x and y directions (as shown in FIG. 2A). Since motion in the x and y directions are de-coupled, it is convenient to plot both directions in a single plot, focusing on the region(s) where stable trajectories are possible simultaneously in both the x and y directions. This region of stability is designated the "bandpass region".

According to the analytical theory based on the Mathieu equation, any set of voltages which do not lie within one of these regions of stability (in both x and y directions) will result in an unstable trajectory of ions, with exponentially increasing acceleration from the centerline of the quadrupole in the instable direction (x or y). These stability boundaries tend to be very sharp, and can therefore be used to reject certain masses while accepting other masses. Since each mass has a unique set of stable voltages, judicious selection of voltages can allow selection of a narrow bandpass of masses to be transmitted through the quadrupole at the expense of all others as illustrated in FIG. 2B. Quadrupole mass spectrometers are typically scanned through the mass range by increasing both RF and DC voltages while maintaining a constant ratio (see "Scan Line" in FIG. 2B). The slope of the scan line determines the resolution of the mass spectrometer.

There is evidence that these stability boundaries observed with convention quadrupole operation are independent of the operating pressure, and therefore that mass resolution should be possible even for a quadrupoles operated at higher pressures, such as atmospheric pressure. The majority of research with higher pressures has occurred in the pressure range of $1\times10^{-5}$ to $1\times10^{-1}$ torr with the three-dimensional quadrupole ion trap (9, 10). It has been clearly observed with three-dimensional quadrupole ion traps that stability boundaries may actually be sharpened at these higher pressures yielding improved resolution. But there are limits with the operating pressures. As the pressure is increased in quadrupole devices the incidence of a gas discharge increases as illustrated in recent studies of ion pipes by Bruce Thomson and coworkers (11).

FIG. 3 illustrates that there are two pressure regimes where time-varying fields can be established at sufficient field strength to affect the radial displacement of unstable ions; the first is at low pressures ($<10^{-2}$ torr, where existing quadrupole mass analyzers are operated) and the second is at atmospheric pressure (100–760 torr, the present invention). The region marked forbidden at intermediate pressures is limited by gas discharge at the higher voltages (or fields) required for quadrupole mass filtering. In addition, scattering effects from discrete collisions between ions and the surrounding gases deleteriously affect the motion of the ions in the intermediate pressure region as well.

Ion Mobility Spectrometry (IMS)

In recent years ion mobility spectrometry (IMS) has become an important analytical tool for measurement of ionized species created in a wide variety of atmospheric pressure ion sources; including, discharge, $^{63}$Ni, and photo-ionization. (12, 13) Recently, a number of researchers have also incorporated the LC/MS type sources of electrospray (ES) and atmospheric pressure chemical ionization (APCI) into IMS. (14, 15, 16, 17)

One recent non-conventional implementation of IMS (known as FAIMS, high-field asymmetric waveform ion mobility spectrometry) utilizes an asymmetric waveform to isolate ions between parallel plates or concentric tubes. (18,

19) This technique demonstrates the principal that we propose with the present invention, in that it utilizes a flow of gas along the z-axis coupled with alternating field conditions to create a bandpass spectrometer. Of particular note is the ability to produce field strengths of well over 10,000 volts per cm without discharge occurring. When coupled to ES and mass spectrometry FAIMS has served as an effective means of fractionation of various molecular weight regimes (20).

Nevertheless all the RF/DC mass filters, linear and three-dimensional quadrupoles and FAIMS heretofore known suffer from a number of disadvantages:

(a) Conventional quadrupole mass analyzers require vacuum components; namely, vacuum chambers, high-vacuum electrical feed-throughs, sealed pumpout lines, gauges and others expensive vacuum related devices that can withstand large pressure differences (up to 1000 torr). This requires sufficiently strong materials such as stainless steel, aluminum, or other vacuum compatible materials; chambers with vacuum tight welds; or metal or rubber seals, all with little or no outgassing.

(b) Conventional quadrupole mass analyzers require expensive high vacuum pumps, such as turbomolecular or diffusion pumps; and low vacuum pumps, such mechanical vane pumps; costing many thousands of dollars. The cost of these pumps can makeup approximately 20% of the total cost of an instrument.

(c) Atmospheric interfaces for quadrupole mass analyzers can require multiple stages of rough pumping and expensive high vacuum pumps for operation, resulting in costly and complex interface designs.

(d) Quadrupole mass analyzers weight several hundred pounds and require a substantial amount of electrical power for operation, heating and cooling, etc.; all restricting their portability.

(e) These all add to the manufacturing cost of a quadrupole mass spectrometer thereby resulting in a large percentage (>50%) of the cost of a mass analyzer being due to the cost of the vacuum system components, including the vacuum pumps (both high and low vacuum), chamber, vacuum feed-throughs; atmospheric pressure interfaces; etc.

(f) FAIMS lack the precision and band pass capabilities of quadrupolar designs or other multi-pole designs, by only utilizing 2 parallel plates instead of multiple poles. In essence by utilizing asymmetric RF voltages between parallel plates FAIMS is forming only one-half of the fields seen in quadrupolar designs, therefore stopping short of the precision and band-pass capabilities of quadrupolar devices.

(g) FAIMS's present design suffers from a very inefficient sampling of atmospheric gas-phase ions into the area between the parallel plates.

SUMMARY

In accordance with the present invention an atmospheric or near atmospheric RF/DC mass analyzer comprises an atmospheric ion source, an ion-focusing region, an RF/DC quadrupole, an atmospheric gas-phase ion detector, and a source of gas.

Objects and Advantages

Accordingly, besides the objects and advantages of conventional quadrupole mass analyzers described in the previous sections, several objects and advantages of the present invention are:

(a) to provide a RF/DC mass analyzer that can be produced in a variety of materials without requiring the need for materials and/or construction that can withstand large pressure difference and sealing associated with vacuum devices;

(b) to provide a RF/DC mass analyzer which does not require the use of high vacuum pumps;

(c) to provide a RF/DC mass analyzer which does not require high vacuum pumps for atmospheric pressure ion-source interfacing;

(d) to provide a RF/DC mass analyzer which both is lightweight and portable;

(e) to provide a RF/DC mass analyzer whose production allows both for an inexpensive and easily mass produced RF/DC device;

(f) to provide a RF/DC mass analyzer which can provide a precise band-pass capability;

(g) to provide a RF/DC mass analyzer which can efficiently sample gas-phase ions at atmospheric pressure.

Further objects and advantages are to provide an atmospheric RF/DC mass analyzer which can be composed of plastic and other easily molded or composit materials; the rods can be solid, tubes, or make of perforated metal sheets; ion source can be an atmospheric pressure ionization source; such as electrospray, atmospheric pressure chemical ionization, photo-ionization; corona discharge; inductively coupled plasma source, etc.; or ion detector can be an active pixel sensor array. Still further objects and advantages will become apparent for a consideration of the ensuing descriptions and drawings.

The lack of vacuum requirement for the present device will enable the present spectrometer to be fabricated with a wide variety of fabrication alternatives not readily available with vacuum devices, such as micro-machining, micro-lithography for lenses and element, lamination, and molding. The result being a less expensive, smaller, lighter, and more portable detection device.

REFERENCES

1 Paul, W., Steinwedel, H., "Mass spectrometer without magnetic field," Z. Naturforsch, 8*a*, pages 448–450 (1953).

2 Dawson, P. H., "Quadrupole Mass Spectrometry and Its Applications," Elsevier: New York (1976).

3 Miller P. E., Denton, M. B., "The quadrupole mass filter: Basic operating concepts," J. Chem. Ed. 63, pages 617–622 (1986).

4 Steel, C., Henchman, M., "Understanding the quadrupole mass filter through computer simulation," J. Chem. Ed. 75, pages 1049–1054 (1998).

5 Titov, V. V., "Detailed study of the quadrupole mass analyzer operating within the first, second, and third, (intermediate) stability regions. I. Analytical approach," J. Am. Soc. Mass Spectrom 9, pages 50–69 (1998).

6 Gerlich, D., "Inhomogeneous RF fields: A versatile tool for the study of processes with slow ions," IN: State-Selected and State-To-State Ion-Molecule Reaction Dynamics. Part 1. Experiments, Ng, C-Y, Baer, M. (eds.), pages 1–176, John Wiley & Sons: New York (1992).

7 Dawson, P. H., "Chapter 2: Principals of operation," IN: Quadrupole Mass Spectrometry and Its Applications, Dawson, P. H. (ed.), pages 9–64, Elsevier: New York (1976).

8 Dawson. P. H., "Chapter 3: Analytical Theory," IN: Quadrupole Mass Spectrometry and its Applications, Dawson, P. H. (ed.), pages 65–78, Elsevier: New York (1976).

9 Johnson, J. V., Pedder, R. E., Yost, R. A. "The stretched quadrupole ion trap: implications for the Mathieu $a_u$ and $q_u$ parameters and experimental mapping of the stability diagram," Rapid Commun. Mass Spectrom. 6, pages 760–764 (1992).

10 Stafford, G. C., Kelly, P. E., Stephens, D. R., "Method of Mass Analyzing a Sample by Use of a Quadrupole Ion Trap", U.S. Pat. No. 4,540,884 (Sep. 10, 1985).

11 Thomson, B. A., Douglas, D. J., Corr, J. J., Hager, J. W., Jolliffe, C. L., "Improved collisionally activated dissociation efficiency and mass resolution on a triple quadrupole mass spectrometer," J. Am. Soc. Mass Spectrom. 6, pages 1696–1704 (1995).

12 Eiceman, G. A., Karpas, Z., "Ion Mobility Spectrometry," CRC Press: Boca Raton (1994).

13 Hill, H. H., Siems, W. F., St. Louis, R. H., McMinn, D. G. "Ion mobility spectrometry," Anal. Chem. 62, pages 1201A–1209A (1990).

14 Wyttenbach, T., von Helden, G., Bowers, M. T., "Gas-phase conformation of biological molecules: Bradykinin," J. Am. Chem. Soc. 118, pages 8335–8364 (1996).

15 Wittmer, D., Chen. Y. H., Luckenbill, B. K, Hill, H. H., "Electrospray ionization ion mobility spectrometry," Anal. Chem. 66, pages 2348–2355 (1994).

16 Covey, T., Douglas, D. J., "Collision cross sections for protein ions," J. Am. Soc. Mass Spectrom. 4, pages 616–623 (1993)

17 Guevremont, R., Siu, K. W. M., Ding, L., "Ion mobility/TOF mass spectrometric investigation of ions formed by electrospray of proteins," Proceedings of the 45$^{th}$ ASMS Conference on Mass Spectrometry and Allied Topics, page 374, Palm Springs, Calif. Jun. 1–5, 1997.

18 Guevremont, R, Purves, R., Barnett, D., "Method for Separation and Enrichment of Isotopes in gaseous Phase," WO Patent 00/08456 (Feb. 17, 2000). Guevremont, R, Purves, R., "Apparatus and Method for Atmospheric Pressure 3-Dimensional Ion Trapping," WO Patent 00/08457 (Feb. 17, 2000). Purves, R., Guevremont, R, "Electrospray ionization high-field asymmetric waveform ion mobility spectrometry-mass spectrometry," Anal. Chem. 71, pages 2346–2357 (1999).

19 Buryakov, I. A., Krylov, E. V., Nazarov, E. G., Rasulev, U. Kh., "A new method of separation of multi-atomic ions by mobility at atmospheric pressure using a high-frequency amplitude-asymmetric strong electric filed," Int. J. Mass Spectom. Ion Processes. 128, pages 143–148 (1993).

20 Ells, B., Barnett, D. A., Froese, K., Purves, R. W., Hrudey, S., Guevremont, R., "Detection of chlorinated and brominated by products of drinking water disinfection using electrospray ionization-high-field asymmetric waveform ion mobility spectrometrymass spectrometry," R., Anal. Chem. 71, pages 4747–4752 (1999).

BRIEF DESCRIPTION OF FIGURES

In the drawings, closely related figures have the same number but different alphabetic suffixes FIG. 1 Prior Art. Rod assembly and polarity configuration for a conventional (vacuum) quadrupole. The applied voltages, variable in time t at frequency Ω, showing both the DC component $V_{dc}$; and the alternating component $V_{rf}$. $V_{ion}$ energy is a fixed DC potential on the rods (commonly referred to as pole bias) that determine the energy of ion in the z-direction.

REFERENCE NUMBERS IN DRAWINGS

Figure 1:
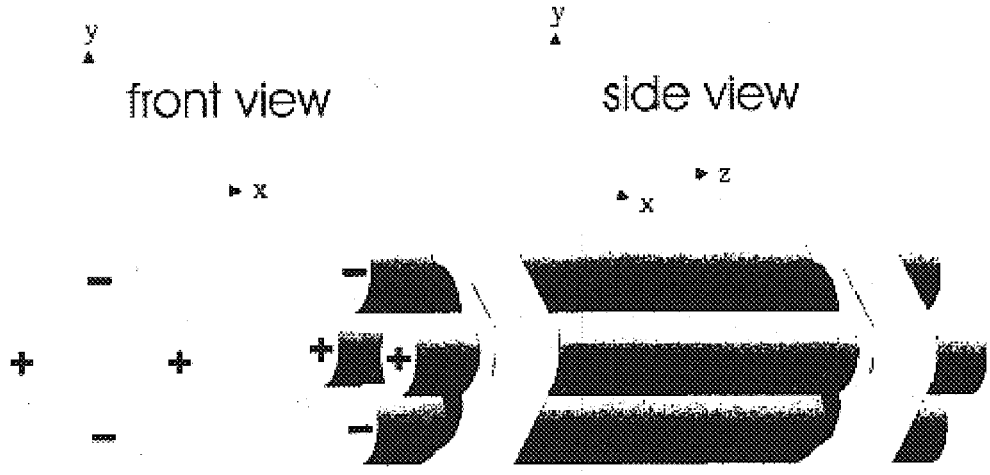
Figure 1:
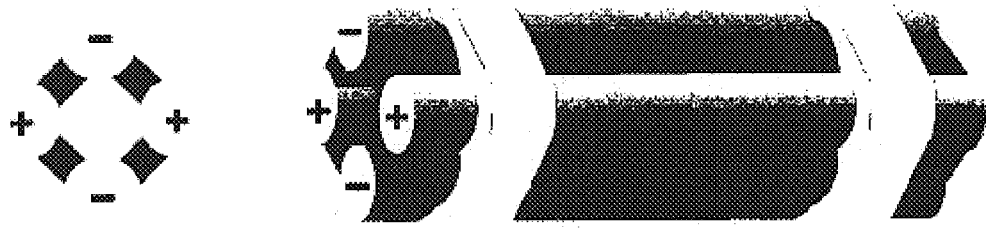
Figure 2:
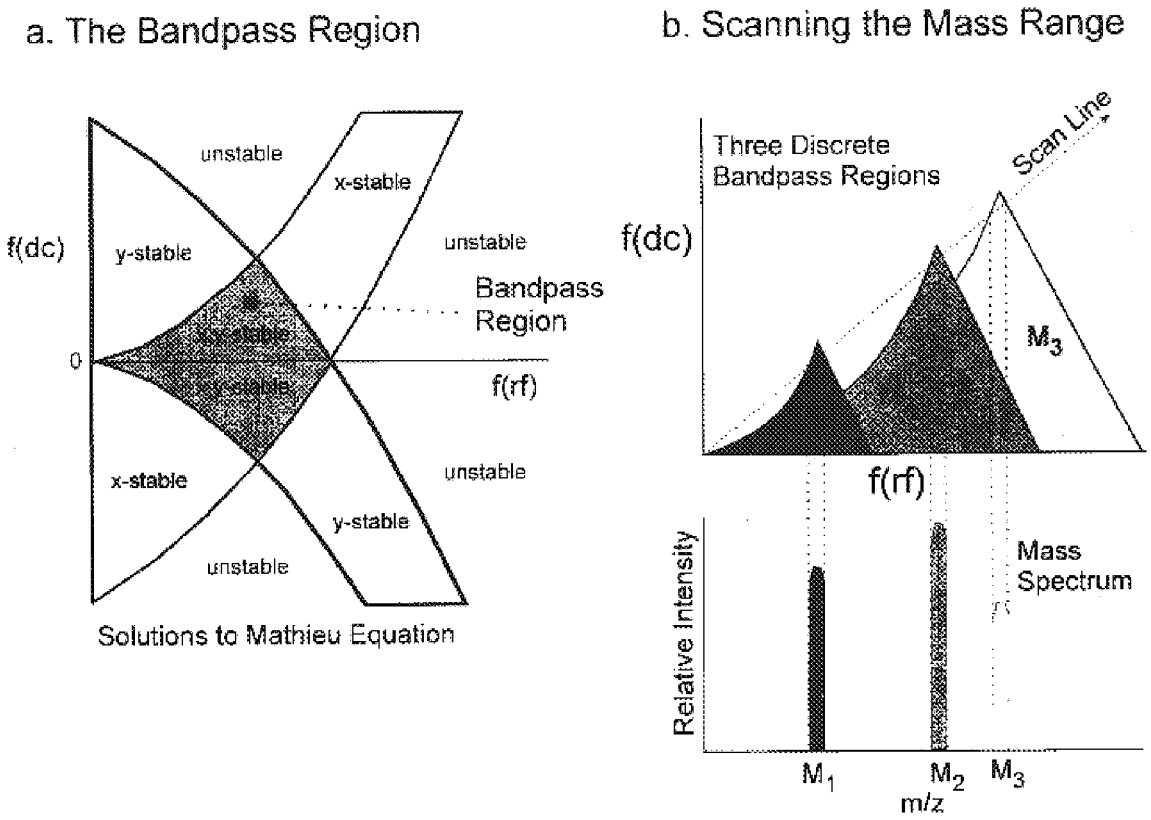
FIGS. 2A and 2B Prior Art. (2A) x, y-stability regions for a given mass in a quadrupole mass filter, with axis label with rf and dc functions rather than traditional a and q values. The overlap indicates the bandpass region. (2B) The bandpass region of the stability diagram for three masses indicating how they result in mass resolution through rejection of adjacent masses due to instability FIG. 3 Applied Voltage of the RF ($V_{rf}$) (peak-to-peak) versus observed discharge limit as a function of pressure. Both conventional (vacuum) and atmospheric pressure operating regimes are shown.
Figure 3:
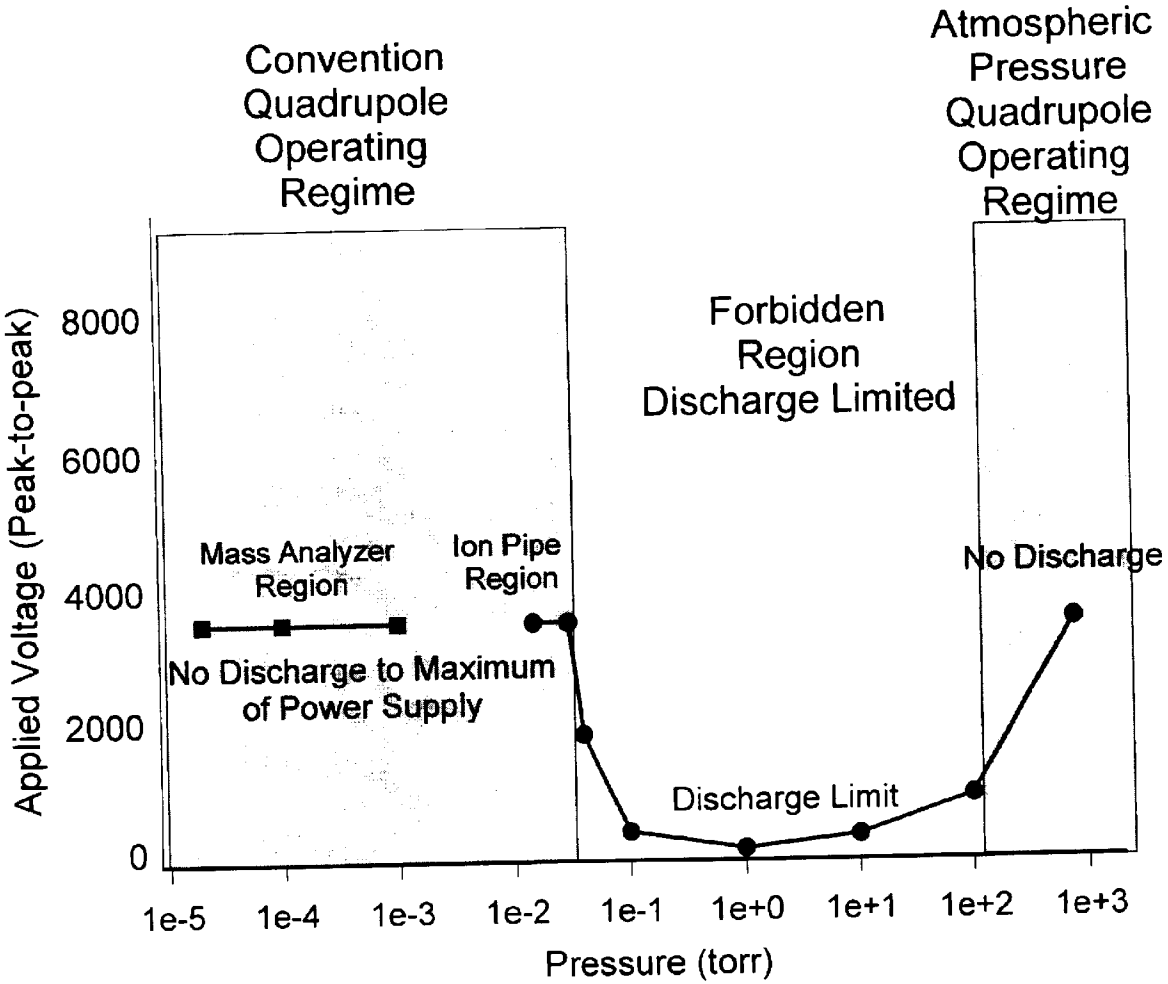

10 Ion Source Region
12 gas inlet
14 analyzer housing
20 Focusing Region
22 electrical lead
30 Quadrupole Region
32 electric lead
40 Ion Detector Region
42 electrical lead
44 electrical lead
46 gas-exhaust port
50 conductive electrospray ionization chamber
52 ionization region
54 electrospray needle
56 insulator
60 high transmission element
62 entrance lens
64 insulator
66 aperture
72 atmospheric RF/DC quadrupole filter assembly
74 individual primary electrodes
76 insulator
78 rods
90 Detector Region housing
92 second high transmission element
94 exit lens
96 ion detector
98 ion exit opening

100 rear wall
110 curved shaped surfaces
112 insulator
114 rectangular bar
116 insulator
120 primary electrode
122 primary electrode
124 insulator
130 first filter
132 second filter
134 third filter
170 aperture or capillary tube
180 mass spectrometer region

DESCRIPTION

Figure 4:
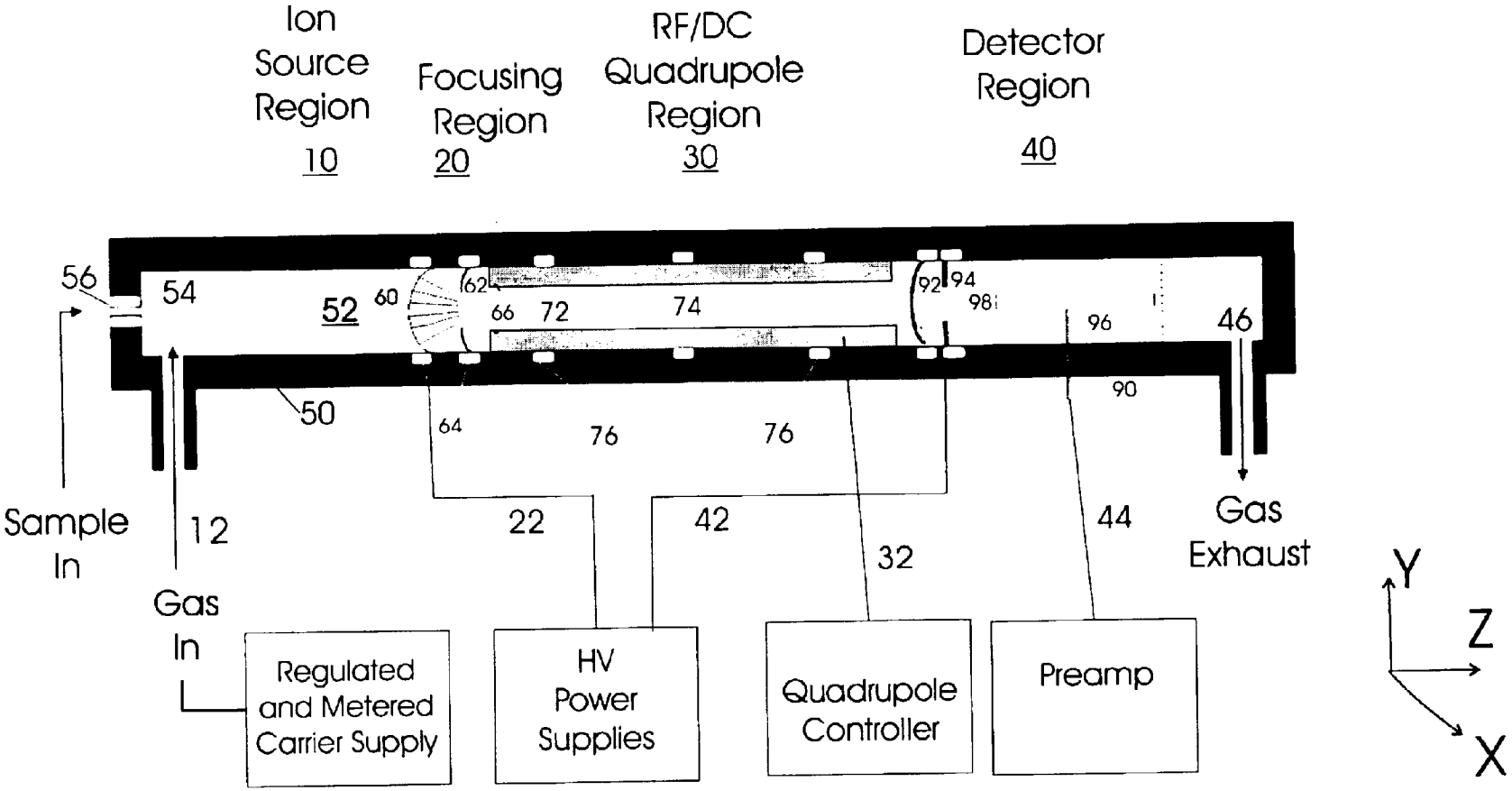
FIG. 4 is a representation of the essential features of the atmospheric RF/DC device, depicting a quadrupole device. Also shown are the location of the ion source and ion focusing region, with a hemispherical high transmission element for introducing ions into the device, at the entrance of the quadrupole RF/DC filter; the sample and carrier gas inlets; the detector region at the exit of the quadrupole device with a hemispherical high transmission element for collecting and focusing ions into or onto an ion detection apparatus; and gas exhaust.
Figure 5:
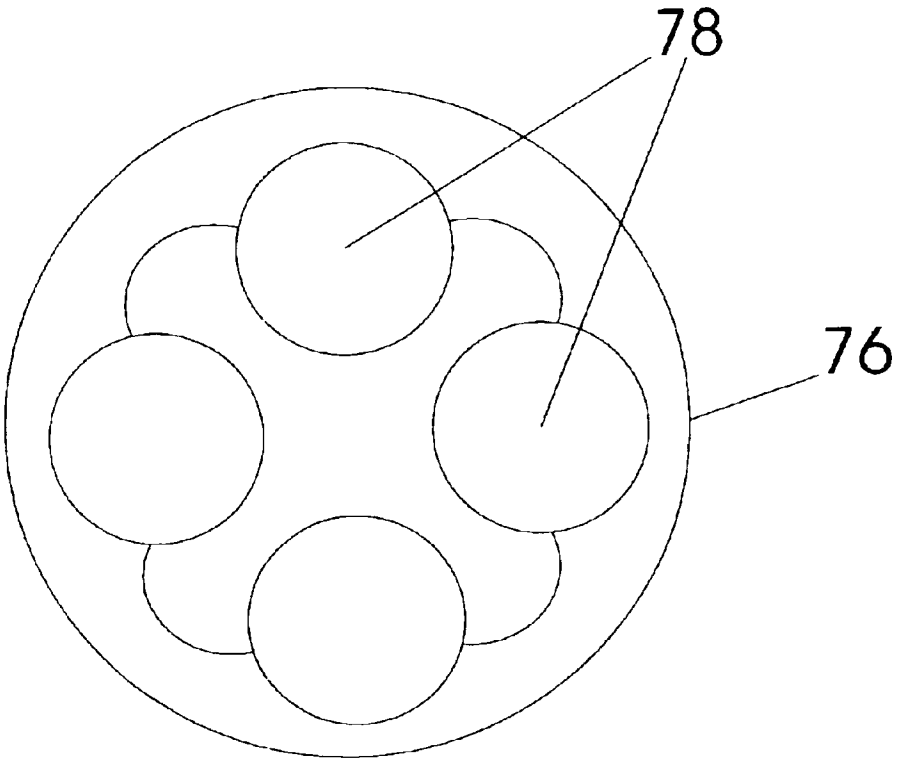
FIG. 5 is a schematic end view of a quadrupole RF/DC atmospheric filter including the electrically insulating mounting bracket.

Preferred Embodiment—FIGS. 4 and 5 (Basic Focusing Device)

A preferred embodiment of the atmospheric RF/DC device of the present invention is illustrated in FIG. 4. Basic parts include an Ion Source Region 10, Focusing Region 20, RF/DC Quadrupole Region 30, and Detector Region 40. The Ion Source Region 10 is mounted at one end of the analyzer housing 14 and is symmetrically disposed about the central axis Z. The ion source may comprise, for example, a conductive electrospray ionization chamber 50 comprised of an ionization region 52, an electrospray needle 54, an insulator 56, and a gas inlet 12. A carrier gas is supplied upstream of Ion Source Region 10 through gas inlet 12 from the gas supply source. The gas is generally composed of, but not limited to nitrogen. This device is intended for use in collection and focusing of ions from a wide variety of ion sources at atmospheric or near atmospheric pressure; including, but not limited to electrospray, atmospheric pressure chemical ionization, photo-ionization, electron ionization, laser desorption (including matrix assisted), inductively coupled plasma, and discharge ionization. Both gas-phase ions and charged particles emanating from the Ion Source Region 10 are collected and focused with this device.

A high transmission element 60 is positioned symmetrically about the Z-axis adjacent to the entrance lens 62 and downstream of the Ion Source Region 10, in the Focusing Region 20. The high transmission element (as described in Provisional Patent Application No. 60/210,877, Jun. $9^{th}$, 2000) is electrically isolated from the housing 14 and entrance lens 62 by insulators 64. The opening of the entrance lens defines an entrance aperture 66. Electric lead 22 schematically depict the connections required to operate the high transmission element and entrance lens.

Downstream of the Focusing Region 20 is the Quadrupole Region 30 which contains the atmospheric RF/DC quadrupole filter assembly 72. Individual primary electrodes 74 in assembly 72 are held in place and electrically isolated from the cylindrical electrically conductive housing 14 by insulator 76. The primary electrodes 74 are in the form of cylindrical conducting rods or poles extending parallel to one another and disposed symmetrically about the central axis. The X rods lie with their centers in the X-Y plane, and the Y rods lie with their centers on the Y-Z plane Electric lead 32 schematically depict the connections required to operate the quadrupole filter. FIG. 5 illustrates a cross section of the quadrupole. The four rods 78 are held in an equally spaced position and equal radial distance from the centerline by attachment to insulator 76.

A second high transmission element 92 and an exit lens 94 are located downstream of the Quadrupole Region 30, in the Ion Detector Region 40. The Ion Detector Region 40 is enclosed by a housing 90. Electric lead 42 schematically depict the connections required to operate the second high transmission element and exit lens. An ion detector 96, such as a faraday plate or tessalated array detector is symbolically provided with electrical leads 44, and may be conveniently mounted on the exit lens 94. The lens 94 defines an ion exit opening 98 centered on the Z-axis. In addition, a gas-exhaust port 46 is located at the end of the housing 90 downstream of the detector 96.

Figure 9:
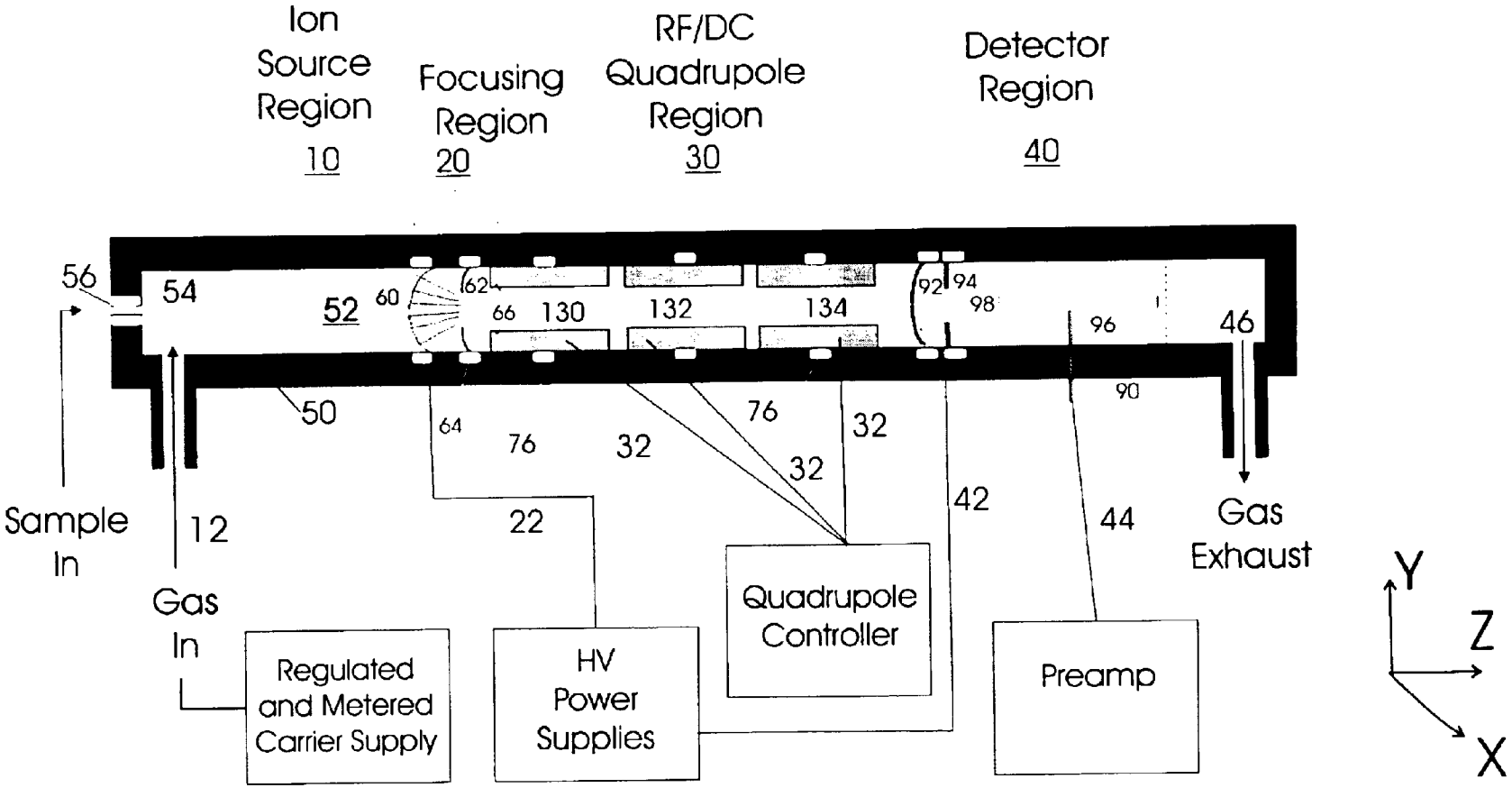
FIG. 9 is a representation of a RF/DC atmospheric filter, depicting three tandem quadrupole filters.
Figure 10:
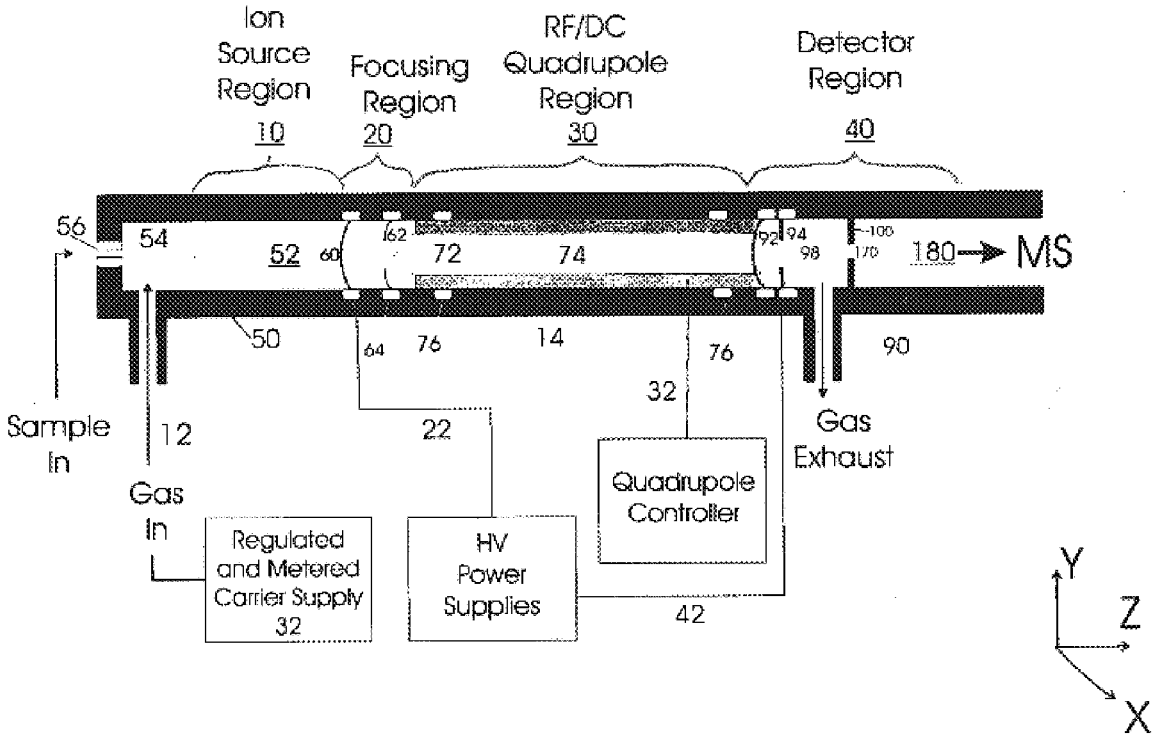
FIG. 10 is a representation of the atmospheric RF/DC device, the region at the exit of the quadrupole filter is occupied by an atmospheric interface for the introduction of ions into a low pressure mass spectrometer.

Additional Embodiments—FIGS. 9, 10,—(Segmented Rods, Detectors)

Additional embodiments are shown in FIGS. 9 and 10.

In FIG. 9 the atmospheric RF/DC filter assembly shows a segmented quadrupole filter in the same manner as FIG. 4, however the filter is composed, in this case, of a primary or first filter 130 and two auxiliary filters, a second filter 132 and a third filter 134 in series.

In FIG. 10 the RF/DC atmospheric focusing device shows an aperture or capillary tube 170 for an atmospheric ionization interface to a mass spectrometer mounted in the Detector Region 40 and is symmetrically disposed about the central axis Z. The rear wall 100 defines an exit aperture 170 centered on the Z axis. Aperture 170 has a diameter appropriate to restrict the flow of gas from the Ion Detector Region 40, at or near atmospheric pressure, to region 180. In the case of a vacuum detection, such as mass spectrometry in region 180, typical aperture diameters are 100 to 500 um.

Figure 6:
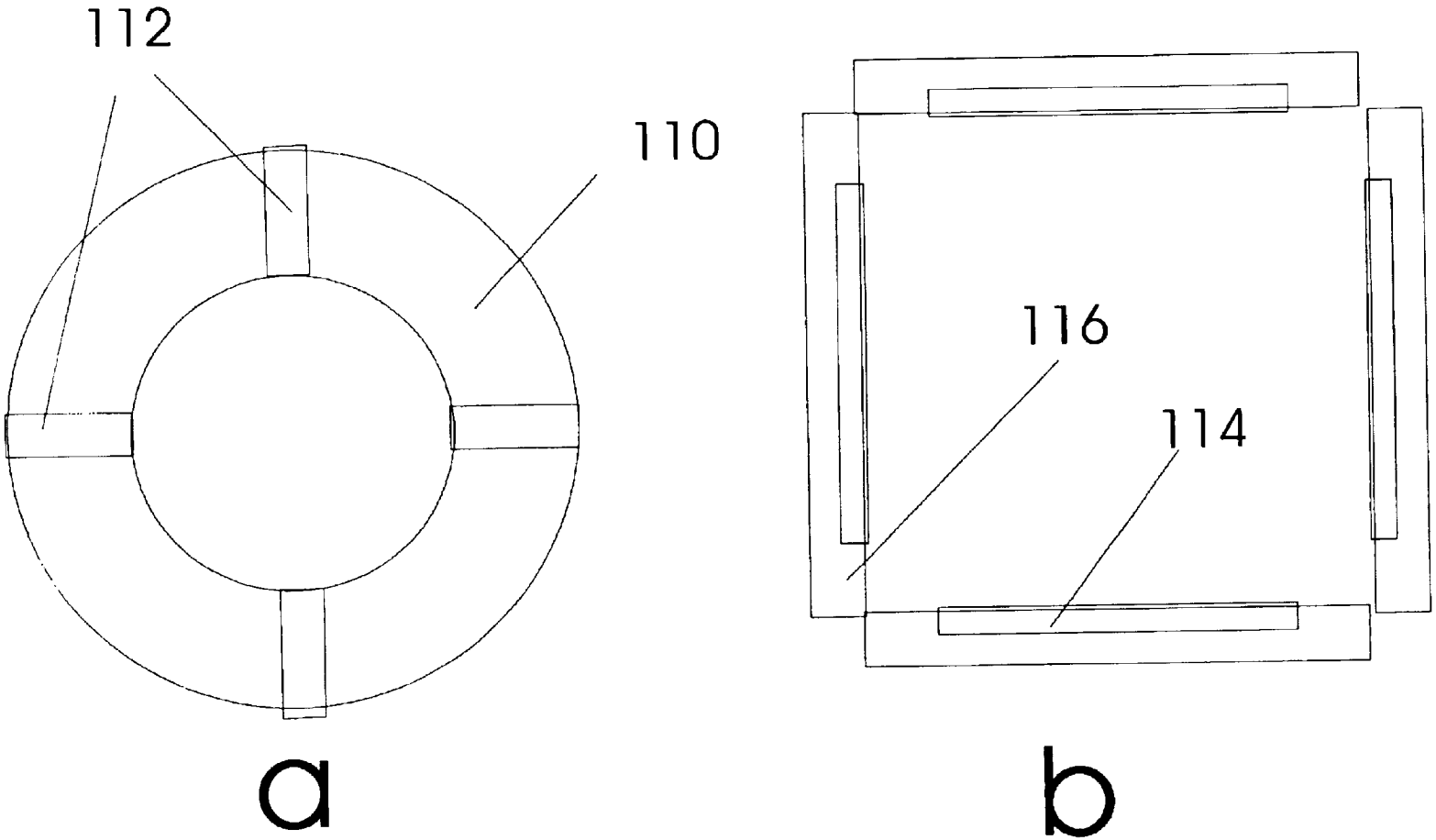
FIGS. 6A and 6B are schematic end views of quadrupole RF/DC atmospheric filters with curved surfaces (6A) and rectangular bars (6B), including the electrically insulating mounting brackets.
Figure 7:
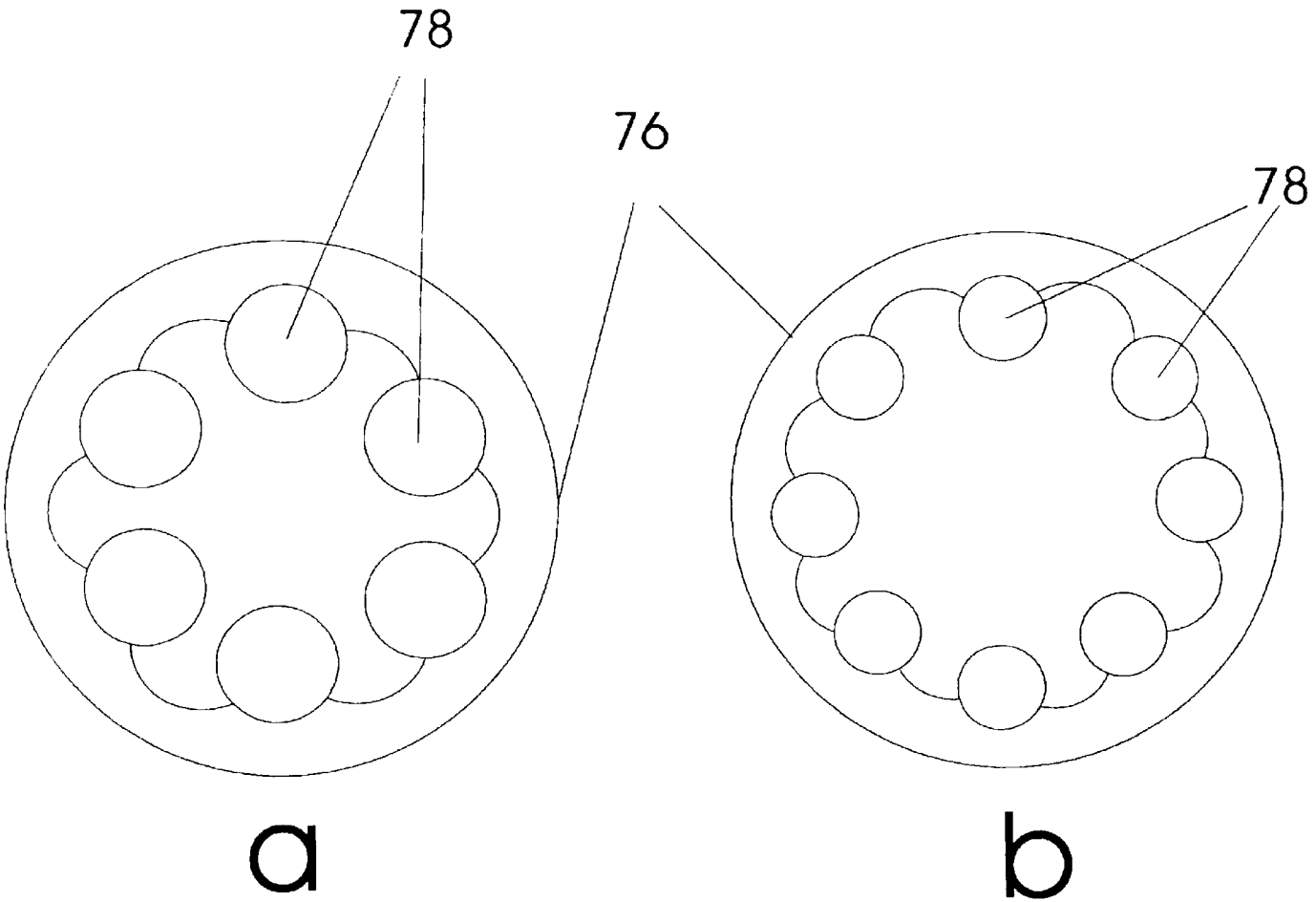
FIGS. 7A and 7B are schematic end views of hexapole (7A) and octopole (7B) RF/DC atmospheric filter including the electrically insulating mounting brackets.
Figure 8:
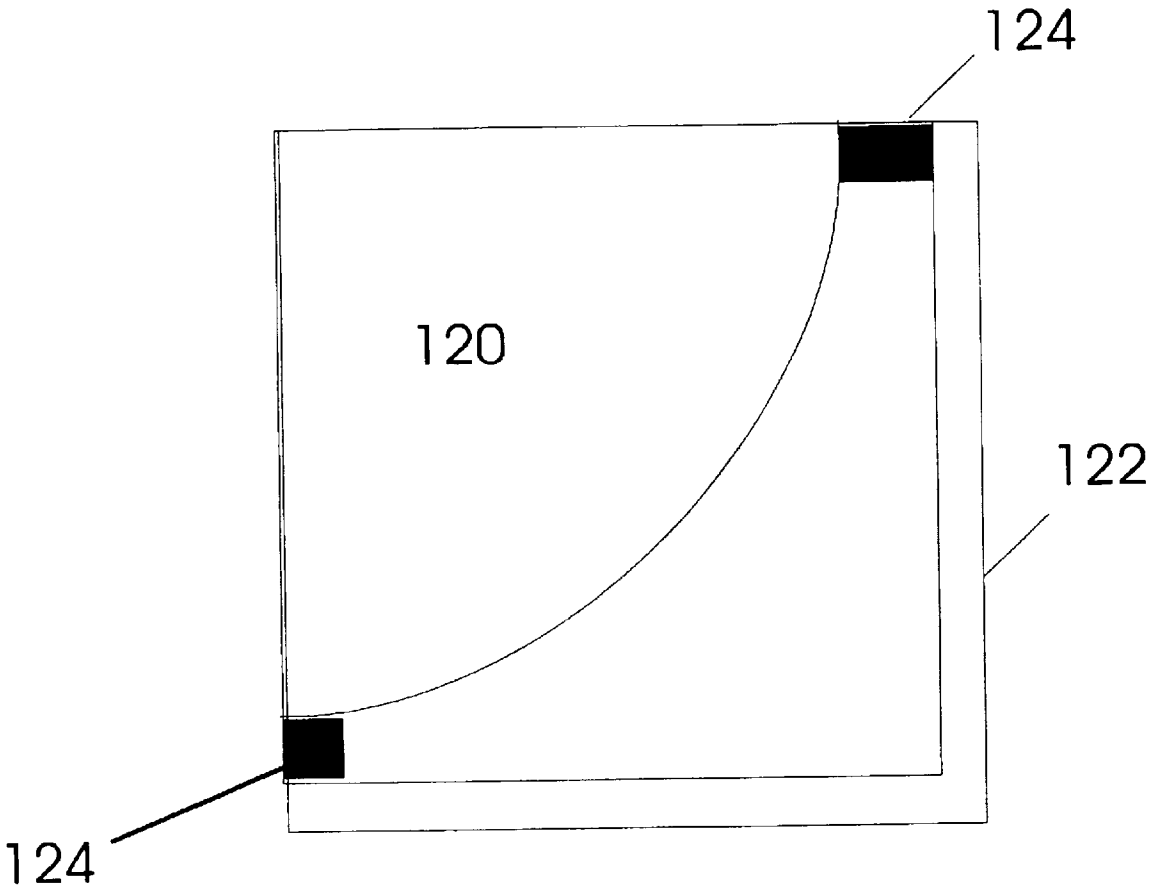
FIG. 8 is a schematic end view of a monopole RF/DC atmospheric filter.

Alternative Embodiments—FIGS. 6, 7, 8—(Shapes, Multi-poles, Mono-pole, Manufacturing)

There are various possibilities with regard to the shape and number of poles of the RF/DC atmospheric filter.

FIG. 6*a* illustrates a cross section of the Quadrupole Region where the four cylindrically shaped rods (in FIG. 5) are replaced by curved shaped surfaces 110. Insulators 112 serves the dual purpose of supporting the curved surfaces 110 and filling in the space between the edges of the curved surfaces.

FIG. 6*b* illustrates a cross section of the Quadrupole Region where the four cylindrically shaped rods (in FIG. 5) are replaced with four rectangular bars 114 mounted in insulating materials 116. Insulators 116 serves the dual purpose of supporting the rectangular bars and forming a flush surface where the surface of the bar 114 and the insulator 116 meet.

FIG. 7 illustrates a cross section of the Quadrupole Region where the four cylindrically shaped rods (in FIG. 5) are replaced with either six (a hexapole, FIG. 7*a*) 78 or eight (an octopole, FIG. 7*b*) 78 rods.

A monopole filter is illustrated in FIG. 8 and includes primary electrodes 120 and 122. Electrodes 120 and 122 are held by attachment to insulator 124. Electrically the monopole filter is exactly one-fourth of the quadrupole filter. The replacement of three of the rods with a conducting surface in the form of a 90-degree angle plate 122 as shown in FIG. 8 provides the same type of hyperbolic field as that provided in the quadrupole filter illustrated in FIG. 5.

Alternatively, the atmospheric RF/DC filter may be manufactured by using the techniques of microelectronics fabrication: photolithography for creating patterns, etching for removing material, and deposition for coating the surfaces with specific materials.

Advantages

From the description above, a number of advantages of our atmospheric RF/DC mass filter become evident:

(a) Without the need for a vacuum interface between the ion source and the RF/DC mass filter there is no need for high vacuum pumps, vacuum interlocks and feed-throughs, small apertures for interfacing, all of which are expensive and can complicate the interface design.

(b) Without the need for a vacuum chamber, high vacuum pumps, vacuum feed-throughs, etc., all of which add to the cost of the analyzer, the RF/DC mass analyzer can be mass produced inexpensively.

(c) Being at atmospheric pressure there is no need for vacuum interlocks, thus avoiding the need to vent the system for maintenance or repair.

(d) Not requiring a vacuum chamber and large power requirements of the high vacuum pumps, the mass analyzer can be made of light weight material and not be tethered to one location.

Operation of the Basic Device (As shown In FIGS. 4 and 10)

The manner of using the RF/DC atmospheric quadrupole device to collect, focus, and separate ions based on their mass to charge ratio is as follows. Ions supplied or generated in the Ion Source Region 10 from the electrospray source are attracted to the high transmission element 60 by an electrical potential difference between the Ion Source Region 10 and the potential on element 60. The ions will tend to follow the field lines through the Ion Source Region 10 traverse the high transmission element 60 and enter the entrance aperture 66 of the entrance lens 62. Such means are described and illustrated in our U.S. Provisional Filing No. 60/210,877. In addition a sweep gas is also added in Ion Source Region 10. The combination of the potential difference and the flow of the sweep gas cause the ions to be focused at or near a small cross-sectional area at the entrance to the Quadrupole Region 30.

As the ions or charged particles are swept into the Quadrupole Region 30 the RF, or RF and DC potential fields effectively trap the ions in a pseudo-potential well preventing their dispersion in the radial (X-Y) plane. While their movement along the longitudinal z-axis is driven by the gas flow supplied from Ion Source Region 10. RF and DC potentials can be selected to trap specific ions or a range of ions that are stable within the quadrupole assembly 72. At the appropriate RF and DC ratios ions that are not stable will drift off the central axis and eventually collide with rods. The ions that remain in the center are swept out of the quadrupole cylinder exiting out and into the Detector Region 40.

In the operation of this device as an atmospheric inlet to the mass spectrometer (FIG. 10), the detector 96 is replace with an aperture 170 through which focused ions will travel on their path into a vacuum system. Both focusing fields and viscous forces will cause ions in the region of aperture 170 to travel into the vacuum system of the mass spectrometer in region 180. It is intended that this atmospheric RF/DC focusing device be coupled to the vacuum inlet of any conventional mass spectrometer or the atmospheric pressure inlet to any ion mobility spectrometer.

Operation of Monopole and Multipole Devices (As shown in FIGS. 7 and 8)

The operation of the present invention will collect and focus ions and charged particles utilizing other configuration of filter assembly 72 (in FIG. 4), such as, single (FIG. 8), or multiple primary electrodes, typically hexapole (FIG. 7*a*) or octopole (FIG. 7*b*) filters. These devices operate under the same principles as a quadrupole filter in FIG. 4. Sources of ions are swept through the entrance aperture 66, where RF and DC potentials can be selected to focus and pass ions into the Detector Region. For a monopole the primary electrode 120 is connected to suitable RF and DC potential sources while electrode 122 is connected to ground.

There are also noteworthy alternative operating modes for multipole RF filters in terms of the mass range of ions to be analyzed are different. For example, for a given RF potential, an octopole will transmit ions of wider mass range than a quadrupole. Thus utilizing a quadrupole device for situations where the mass range is narrow, such as for the analysis of gases, i.e, oxygen, carbon dioxide, carbon monoxide, and utilizing an octopole device for application where the mass range is large or unknown, such as for the analysis of proteins.

Operation of Segmented Devices (As shown in FIGS. 9)

This invention may also operate in a mode whereby ions are collected and focused with segmented RF/DC filter. This allows different operating values, such as, RF and DC potentials, to be set per filter but increases system complexity and cost. For example, FIG. 9 is a diagram of a RF/DC quadrupole filter with three segmented sections. Ions are swept through the entrance aperture 62 and into the first quadrupole filter 130, where the RF only operation results in virtually all ions and particles being compressed into the center of the quadrupole field. As the focused ions flow into the second quadrupole filter 132, where the RF and DC potentials are selected to act as a low-pass mass filter, larger mass ions and particles are rejected. The remaining ions then enter the last and third quadrupole filter 134, where the RF and DC potentials are selected to pass all the remaining ions, which are then sweep by the carrier gas into the Detector Region 40. In addition, the segmented quadrupole filters can be operated with independent values of frequency and RF and DC potentials, optimizing the transport of ions while eliminating charged particles which may contaminate detectors or clog small apertures. Similar to the continuous RF filter, a segmented RF filter can be used to transport a select range of masses while rejecting ions or charged particles outside this range.

This improved RF and DC atmospheric filter provides the desired focusing and selection of ions at atmospheric or near atmospheric mode of operation by means of an inexpensive and simple structure. The device operates at high efficiency and selectivity as a result of RF and DC excitation and collisional damping compared to that of the prior art systems of focusing and selecting ions and charged particles at atmospheric pressure.

Conclusion, Ramification, and Scope

Accordingly, the reader will see that the atmospheric RF/DC mass filter of this invention can be used to separate gas-phase ions from an electrospray ion source based on their mass-to-charge ratio (m/z), can be used as an atmospheric inlet to a mass analyzer; and can be used to pass a wide or a narrow mass range of ions. In addition, segmented quadrupole filters can be operated with independent values of frequency and RF and DC potentials and thus optimizing the passage of ions while eliminating charged particles which may contaminate ion detectors or clog small apertures.

Furthermore, the atmospheric RF/DC filter has the additional advantages in that:

- it permits the production of RF/DC filters to be inexpensive;
- it provides an atmospheric RF/DC filter which can be made from molded materials;
- it provides an atmospheric RF/DC filter which is both lightweight and portable;
- it allows access to and maintenance of RF/DC filters to be simple and accomplished without tools;
- it allows atmospheric or near-atmospheric ionization sources to be easily interfaced to RF/DC mass filters without the need for complex and costly vacuum system interface; and
- it allows for all or nearly all ions formed at atmospheric pressure to be introduced into the RF/DC mass filter.

Although the description above contains many specifications, these should not be construed as limiting the scope of the invention but as merely providing illustrations of some of the presently preferred embodiments of this invention. For example, the RF/DC device can be composed of multiple RF/DC filters in parallel; the rods of the RF/DC device can have other shapes such as, tapered, hourglass, barrel, etc.; the rods can have various cross-sectional shapes, such as circular, oval, hyperbolic, circular trapezoid, etc.; the rods can be composed of solid cylinders, tubes, tubes made of fine mesh, composites, etc.; the ion source region can be composed of other means of atmospheric or near atmospheric ionization, such as photoionization; corona discharge, electron-capture, inductively couple plasma; the ion detector can be have other means of detecting gas-phase ions, such as active pixel sensors, etc.

Thus the scope of the invention should be determined by the appended claims and their legal equivalents, rather than by the examples given.

We claim:

1. Apparatus for the focusing and selecting of gas-phase ions and/or particles at or near atmospheric pressure, the apparatus comprising:

a. a dispersive source of ions;

b. a means for providing a concentric flow of gas;

c. a first conductive high-transmission element composed of a surface populated with a plurality of holes and an entrance lens so that said gas and substantially all said ions pass unobstructed through into an multi-element assembly, the said surface and entrance lens being supplied with an attracting electric potential by connection to a high voltage supply, and generating an electrostatic field between said source of ions and top side of said surface;

d. a multi-element assembly for receiving and transmitting gas and focused ions along the z-axis, the said multi-element assembly being supplied with both RF and DC electric potentials by connection to a quadrupole controller so that said multi-element assembly may act as a mass filter for said ions and generating an electrostatic field between backside of said entrance lens and multi-element assembly;

e. a second conductive high-transmission element composed of a second surface populated with a plurality of holes and an exit lens so that substantially all said ions exiting said multi-element assembly pass unobstructed through said second element toward a small cross-sectional area on an ion detector, while said gas passes unobstructed pass ion detector and exits out gas exhaust, the said second surface and exit lens being supplied with an attracting electric potential by connection to a high voltage supply, and generating an electrostatic field between said multi-element assembly and top side of said second surface;

f. an ion detector for detecting substantially all said ions passing through said exit lens, whereby to provide detection of ions separated at or near atmospheric pressure through said mass filter.

2. The apparatus of claim 1 wherein said ion detector is a faraday cup operated at or near atmospheric pressure.

3. The apparatus of claim 1 wherein said ion detector is a tessalated or active pixel array sensor operated at or near atmospheric pressure.

4. The apparatus of claim 1 wherein said multi-element assembly is comprised of metal poles or rods.

5. The apparatus of claim 1 wherein said multi-element assembly is comprised of metal tubes or tubes of fine mesh metal screens.

6. The apparatus of claim 1 wherein said multi-element assembly is comprised of concave metallic structures.

7. The apparatus of claim 1 wherein said multi-element assembly is comprised of rectangular metal plates that are solid or perforated or a combination thereof.

8. The apparatus of claim 1 wherein said multi-element assembly is comprised of two or more metal rods or plates.

9. The apparatus of claim 1 further including at least one additional multi-element assembly in tandem with said multi-element assembly, said additional multi-element assembly also at or near atmospheric pressure.

10. The apparatus of claim 1 wherein said gas-phase ions are formed by means of atmospheric or near atmospheric ionization sources such as, electrospray, atmospheric pressure chemical ionization, atmospheric laser desorption, photoionization, discharge ionization, inductively coupled plasma ionization.

11. The apparatus of claim 1 wherein said atmospheric or near atmospheric ionization source is made up of a plurality of said atmospheric or near atmospheric ion sources operated simultaneously or sequentially.

12. The apparatus of claim 1 wherein further said ion detector is an analytical apparatus with an aperture or capillary tube sandwiched between said exit lens and said analytical apparatus, said small cross-sectional area of ions being directed through said aperture into said analytical apparatus.

13. The apparatus of claim 12 wherein further said analytical apparatus comprises a mass spectrometer or an ion mobility spectrometer or combination thereof.

14. Apparatus for the focusing and selecting of an aerosol of gas-phase ions or charged particles at or near atmospheric pressure, the apparatus comprising:

a. a source of ions or charged particles;

b. a concentric flow of gas;

c. a first conductive high-transmission element composed of a surface populated with a plurality of holes and an entrance lens through which gases and substantially all said ions pass unobstructed into an RF/DC quadrupole, the said surface and entrance lens being supplied with an attracting electric potential by connection to a high voltage supply, and generating an electrostatic field between the said source of ions, from atmospheric ion source, and the top side of said surface;

d. a RF/DC quadrupole assembly for receiving and transmitting gas and focused ions along the z-axis, the said quadrupole being supplied with both RF and DC electric potentials by connection to a high voltage supply or quadrupole controller so that said quadrupole assembly may act as a mass filter for said ions and generating an electrostatic field between backside of said entrance lens and said quadrupole assembly and operating at a pressure and voltage as not to form an electrical discharge;

e. a second conductive high-transmission element composed of a second surface populated with a plurality of holes and an exit lens so that substantially all said ions and gas exiting said quadrupole assembly pass unobstructed through said second element toward a small cross-sectional area in an aperture or capillary tube, the said second surface and exit lens being supplied with an attracting electric potential by connection to a high voltage supply, and generating an electrostatic field between the said quadrupole assembly and the top side of said second high transmission surface, while said gas exits through a gas exhaust and aperture;

f. an aperture or capillary tube for receiving substantially all said ions, the said aperture being supplied with an attracting electrostatic potential, and generating an electrostatic field between the backside of said exit lens and said aperture whereby electric field lines are concentrated to a small cross-sectional area on said aperture;

g. an analytical apparatus in communication with the said aperture, wherein said aperture is sandwiched between said exit lens and the analytical apparatus, said cross-sectional area of ions being directed through said aperture into said analytical apparatus, whereby to provide detection of ions separated at or near atmospheric pressure through said quadrupole mass filter.

15. The apparatus of claim 14 wherein said analytical apparatus comprises a conventional vacuum-based mass spectrometer and the ions may or may not be collisionally dissociated by conventional means whereby the atmospheric mass filter serve as the first stage of a tandem mass spectrometer.

16. The apparatus of claim 14 wherein said analytical apparatus comprises an ion mobility spectrometer.

17. The apparatus of claim 14 wherein said gas-phase ions are formed by means of atmospheric or near atmospheric ionization sources such as, electrospray, atmospheric pressure chemical ionization, atmospheric laser desorption, photoionization, discharge ionization, inductively coupled plasma ionization.

18. The apparatus of claim 14 further including at least one additional RF/DC quadrupole assembly in tandem with said RF/DC quadruple assembly.

19. The apparatus of claim 14 wherein said RF/DC quadrupole assembly is composed of 4 concave metal structures.

20. The apparatus of claim 19 wherein concave structures are made up of perforated metal.

21. A method of mass analysis at atmospheric pressure utilizing an ion source region, a focusing region, a RF/DC quadrupole region, and detector region, admitting a concentric flow of gas into said ion source region so that a gas-phase ion and gas may travel through said focusing region, said RF/DC quadrupole region, and into said detector region, and said method comprising:

a. producing ions of a trace substance in said ion source region, b. directing said gas and ions through a first high transmission element in said focusing region into a RF/DC quadrupole in said RF/DC quadrupole region, first through said focusing region, and then through said RF/DC quadrupole region, and then detecting the ions in said detector region which have passed through said RF/DC quadrupole region, to analyze said substance, c. placing DC potentials on said first high transmission element so that said first high transmission element acts to guide and focus ions therethrough, d. placing RF and DC potentials on said RF/DC quadrupole so that said RF/DC quadrupole acts as a mass filter, e. gas exiting said detector region through gas exhaust, whereby to provide a means of determining the mass of said ions at atmospheric pressure.

22. The method according to claim 21, wherein providing the transfer, focusing, selection, and detection of charged particles or ions from dispersive sources for gas-phase ion analysis, further comprises a second high transmission element with electrostatic attracting potentials, sandwiched between said RF/DC quadrupole region and said detector region for focusing ions exiting said RF/DC quadrupole region onto a small cross-sectional area on an ion detector, such as a faraday cup, in said detector region.

23. The method according to claim 21, wherein providing the transfer, focusing, selection, and detection of charged particles or ions from dispersive sources for gas-phase ion analysis, said RF/DC quadrupole is replaced with another RF/DC device, such as a octopole, hexapole, monopole, etc.

24. The method according to claim 21, wherein providing the transfer, focusing, selection, and detection of charged particles or ions from dispersive sources for gas-phase ion analysis, comprises a plurality of dispersive sources of said ions and charged particles.

25. The method according to claim 21, wherein providing the transfer, focusing, selection, and detection of charged particles or ions from dispersive sources for gas-phase ion analysis, further including at least one additional RF/DC quadrupole in tandem with said RF/DC quadrupole.

26. The method according to claim 21, wherein providing the transfer, focusing, selection, and detection of charged particles or ions from dispersive sources for gas-phase ion analysis, further comprises a second high transmission element in said detector region for focusing ions exiting said RF/DC quadrupole region into a small cross-sectional area for introduction into an analytical apparatus for ion detection through an aperture.

27. The method according to claim 26, wherein further providing the transfer, focusing, selection, and detection of charged particles or ions from dispersive sources for gas-phase ion analysis, said analytical apparatus comprises a mass spectrometer, said mass spectrometer providing a convention means of collisional dissociation or ion detection or combination thereof for operation as a tandem mass spectrometer.

* * * * *